United States Patent [19]

Walsh et al.

[11] Patent Number: 4,541,156

[45] Date of Patent: Sep. 17, 1985

[54] METHODS OF DRYING TUBULAR KNITTED FABRIC

[75] Inventors: Ray P. Walsh, Leicester; David H. Smith, Leicestershire, both of England

[73] Assignee: Pegg Whiteley Limited, Leicestershire, England

[21] Appl. No.: 517,432

[22] Filed: Jul. 26, 1983

[30] Foreign Application Priority Data

Jun. 3, 1983 [GB] United Kingdom ..... 8315351

[51] Int. Cl.[4] ..... D06C 5/00

[52] U.S. Cl. ..... 26/81

[58] Field of Search ..... 26/81, 18.5

[56] References Cited

U.S. PATENT DOCUMENTS

| | | | |
|---|---|---|---|
| 448,817 | 3/1891 | Harder | 26/81 |
| 2,588,624 | 3/1952 | Evans | 26/81 X |
| 2,597,530 | 5/1952 | Redman | 26/81 X |
| 2,714,756 | 8/1955 | Redman | 26/81 X |
| 2,929,127 | 3/1960 | Johnson | 26/81 |
| 3,065,551 | 11/1962 | Cohn et al. | 26/81 X |
| 3,496,647 | 2/1970 | Frezza | 26/81 X |
| 3,762,003 | 10/1973 | Frezza | 26/81 |
| 3,909,890 | 10/1975 | Frezza | 26/81 |

OTHER PUBLICATIONS

DeLerue, R., "Continuous Processing Techniques Designed for Tubular Knit Fabrics", Knitting Times, vol. 48, No. 32, Jul. 30, 1979, pp. 28, 29.

*Primary Examiner*—Robert R. Mackey

*Attorney, Agent, or Firm*—McCormick, Paulding & Huber

[57] ABSTRACT

The invention concerns a method of drying tubular knitted fabric on a continuous basis, which method includes the steps of:

(A) overfeeding a rope of wet fabric (4) after untangling to a first transverse stretcher (20);

(B) transversely stretching the untangled fabric to from 100% to 150% of a final dry fabric width to thereby bring the number of knitted courses per unit fabric length to substantially that in the final dry fabric;

(C) expressing water by nip rollers (10) from the transversely stretched fabric to remove water carried in the interstices of the fabric;

(D) overfeeding the expressed fabric to the exterior of a rotating drying drum (32) at from 0% to 25%;

(E) revolving the fabric around the drum (32) and reducing the water content to from 10% to 40% of the dry fabric weight while passing heated air from the drum exterior to the interior to thereby produce an unstretched, moist elastic fabric;

(F) drawing the fabric from the drum upwardly onto a second transverse stretcher (41) to finally adjust the fabric width and obtain the final fabric width;

(G) blowing air at least partly recirculated from the drum interior onto the fabric on the second transverse stretcher (41) to reduce the water content to less than 10% of the dry fabric weight, some of the air being diverted downwards inside the fabric to form a balloon intermediate the drum and the second transverse stretcher at (28).

5 Claims, 2 Drawing Figures

METHODS OF DRYING TUBULAR KNITTED FABRIC

FIELD OF INVENTION

The invention relates to methods of drying tubular knitted fabric in a continuous manner.

BACKGROUND OF INVENTION

Tubular knitted fabric is appreciated for its innate flexibility and its soft handle or texture. The flexibility means that it is very difficult to process to achieve a desired width and drying tends to harden the handle. Previous drying treatments have hence involved a number of separate stages.

It is among the objects of the invention to provide a method which involves a succession of stages which are combined to give a fabric of an intended width and a good handle while facilitating and simplifying supervision. It is also an object to reduce the number of intermediate stages between drying treatments required and to reduce the attendant transport and storage requirements.

SUMMARY OF INVENTION

According to the invention, there is provided a method of drying tubular knitted fabric on a continuous basis which method includes the steps of (A) overfeeding a rope of wet fabric after untangling to a first transverse stretcher;

(B) transversely stretching the untangled fabric to from 100% to 150% of a final dry fabric width to thereby bring the number of knitted courses per unit fabric length to substantially that in the final dry fabric;

(C) expressing water by nip rollers from the transversely stretched fabric to remove water carried in the interstices of the fabric;

(D) overfeeding the expressed fabric to the exterior of a rotating drying drum at from 0% to 25%;

(E) revolving the fabric around the drum and reducing the water content to from 10% to 40% of the dry fabric weight while passing heated air from the drum exterior to its interior to thereby produce an unstretched, moist elastic fabric;

(F) drawing the fabric from the drum upwardly onto a second transverse stretcher to finally adjust the fabric width and obtain the final fabric width;

(G) blowing air at least partly recirculated from the drum interior onto the fabric on the second transverse stretcher to reduce the water content to less than 10% of the dry fabric weight, some of the air being diverted downwards inside the fabric to form a balloon intermediate the drum and the second transverse stretcher.

The drum here performs more than just its customary drying function. It reduces fabric water content prior to hot air ballooning without stretching the fabric in so doing and permitting the ballooning and drying on the second transverse stretcher to occur without increasing fabric length so retaining the number of knitted courses per unit fabric length obtained as a result of the first transverse stretching operation. Soft fabric having a desired width can thus be obtained.

Apparatus suitable for performing the process may include means for supplying a rope of wet fabric with overfeed; first means for untangling and transversely stretching the rope; expression rollers for squeezing the untangled fabric tube; a means for overfeeding squeezed fabric; a rotary drying drum for receiving fabric from the overfeed means; an upright channel having at the upper end thereof a second means for transversely stretching fabric from the drum; ducting connected to a fan for supplying air to a drum chamber and the second transverse stretching means, and for receiving air from the drum.

A relaxed fabric condition can be maintained throughout the method while the fabric is dried gradually, preferably by moistened heated air.

Other features of the invention can be appreciated from the following description and claims.

DRAWINGS

DESCRIPTION OF SPECIFIC EMBODIMENT

Figure 1:
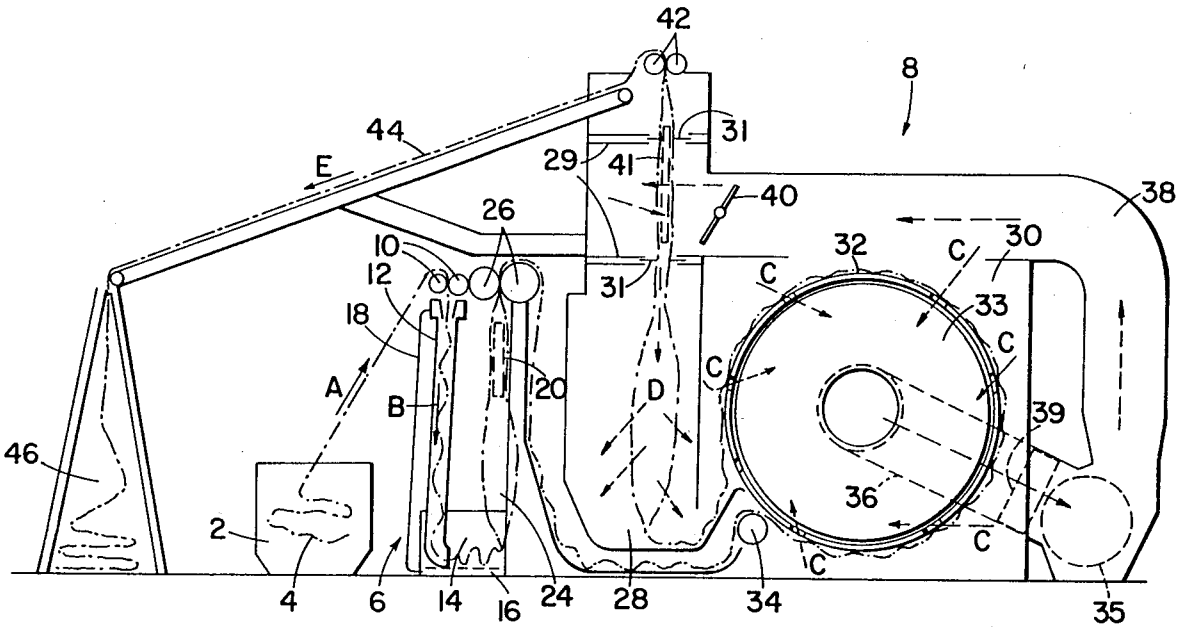
FIG. 1 shows a schematic view of a drying machine for performing the method of the invention.
Figure 2:
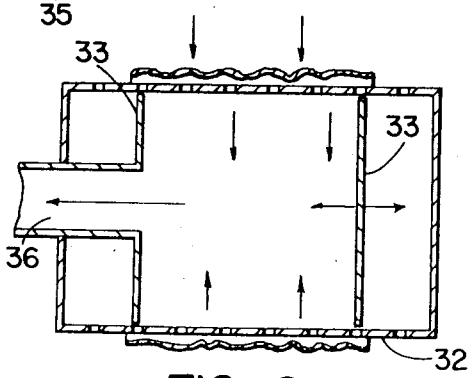
FIG. 2 is a sectional view through the drum in FIG. 1 being taken on a line perpendicular to the view of FIG. 1.

A skip 2 containing a rope of wet cotton interlock knitted fabric 4 is positioned near the front end 6 of the machine 8 and the fabric is drawn upwardly in the direction of arrow A by a pair of rollers 10 and fed downwardly in the direction of arrow B through a wetting out tube 12 to ensure uniform wetness of the fabric. The tube 12 opens out into a drip tray 14 having a perforated bottom to allow drainage into a sump 16 from which water is pumped up into the top of the wetting out tube 6 through a pipe 18.

The now thoroughly wet fabric is drawn up and over a transverse stretcher 20 which is controllable by handweels to adjust the width of the stretcher. Feedwheels of the stretcher 20 are driven via an infinitely variable feed unit (not shown) to give overfeed conditions as required. According to the invention, the desired level of knitted courses per unit fabric length can be obtained by overstretching the fabric widthwise. The desired level of knitted courses per unit length is that obtained during the knitting of the fabric proper and the level is reduced to varying degrees by stretch of the fabric during wet processing.

An operative can, generally speaking, achieve this restoration of course density by overfeeding the fabric to a maximum extent causing the fabric to ripple i.e. bunch up to a slight degree on the edges of the transverse stretcher.

Air jets (not shown) are situated adjacent the stretcher at 24 to balloon the fabric and untangle the fabric to enable it to pass more easily over the stretcher 20. At this early stage, the fabric is manipulated by controlling the width and the overfeed onto the stretcher to compact the knitted courses and give a stitch density suitable for subsequent drying stages. The stretcher 20 feeds the fabric upwards through the nip of the high expression rollers 26 which expel the bulk of the liquor. However, because the stitch density of the knitted fabric has been adjusted just before it enters the nip, the high pressure of the rollers 26, although inevitably flattening the fabric does so while preserving the required number of courses per unit fabric area. The general process so far is similar to that described in the British Pat. No. 2,050,540 (U.S. Pat. No. 4,322,957). The disposition of the subsequent drying and finishing means and the mode of transportation of the fabric is in accordance with the invention devised to ensure that the fabric is maintained relatively relaxed avoiding changes in the course density but allowing for any contraction or expansion as it passes through the machine by changing the width of the fabric.

Having passed through the high expression rollers 26, the fabric, now with approximately 60% water content by weight of the dry fabric, passes downwards and along the bottom of a smooth walled, centrally disposed drying chamber 28 where the fabric moisture content is further reduced. From this central chamber 28, the fabric passes to a second chamber 30 which houses a large diameter (around 2 meters diameter) perforated drum 32 which is rotated and synchronized to the machine drives. The chamber 30 receives hot air from a heating unit (not shown) and a fan 35 recirculates the air by withdrawing it from the interior of the drum 32 through channel 36 and then returning it into the chamber through insulated duct 38. A filter unit 39 may be interpassed for removing lint and impurities. The fabric is fed onto the drum 32 by a rubber covered roller 34 which is driven to overfeed by from 0 to 25% depending on the nature of the fabric. The fabric may be overfed to a maximum degree to create a slightly rippled fabric condition on the drum and is thus maintained in a relaxed condition around the periphery of the perforated drum 32 and the hot air passes through it from the surrounding chamber 30 at the exterior of the drum 32 along the direction of arrow C, thus holding it by suction and enhancing the relaxed drying of the fabric. The drum is provided with internal disc-like baffles 33 adjustable axially of the drum to the width of the fabric processed to concentrate the suction and drying of the fabric to the width being processed. The slightly rippled or corrugated effect may permit some lengthwise shrinkage without leading to excessive fabric tension.

At this stage the moisture content is reduced to about 30% by weight of the dry fabric. The moisture content to which the fabric is dried is arranged to be such that the fabric displays at least some of dimensional stability and elasticity, recovering its dimensions on stretch being applied, the content not being so high that the fabric is "limp". The fabric passes from the drum chamber 30, back into the lower part of the central chamber 28 and then vertically upwards in the chamber 28. There the fabric is ballooned by pre-heated air moving along arrow D. The fabric is evenly expanded by the ballooning but not stretched due to its dimensional stability at this stage before the fabric passes over a second transverse stretcher 41 at which point the moisture content is reduced to less than 10% by weight of the dry fabric to provide a substantially fully dried fabric.

A further air flow control member 40 is situated at the top of the drum chamber 30 in the manner of a butterfly valve and controls the air flow into the upper part of the central vertical chamber 28. This member 40 can be set to control the flow of hot air into the top of the vertical chamber 28. The member 40 reduces the air flow into the top to a small portion of what would be necessary in the absence of the drying effect of the drum 32. The air needs to be less warm and can contain more moisture yet lower the water content of the fabric to a desirable low level. These factors combine to permit a more gentle drying operation at this final stage. The member 40 also controls how much air is supplied to the exterior of the drum 32 so that the drying effect of the air can be subdivided between the drum 32 and the stretcher 41 and balloon as appropriate. The hot air blows into the fabric on the stretcher 41. Baffles 29 and widthwise adjustable baffles 31 restrain air flow to the exterior of the fabric and promote air flow downwards into the lower part of the vertical chamber 28 to cause ballooning of the fabric below the baffles 29 and 31 as illustrated in FIG. 1 over the stretcher. The baffles 31 may be coupled to a stretcher width control mechanism (not shown) so that as the width of the stretcher 41 is varied, gaps at the edges of the fabric at the top and bottom of the chamber 28 are maintained at a minimum so that as much hot air as possible is passed from the upper part of the chamber to the lower part of the chamber inside the fabric tube to cause ballooning and drying. The second stretcher 41 is also controllable while the machine is operating to finally adjust fabric width generally only requiring a marginal widening effect which does not appreciably change stitch density. The fabric finally passes through a pair of steam heated calendar bowls 42 at the top of the machine. The bowls 42 are adjusted to suit the type of fabric and finish required.

Fabric leaving the calendar bowls 42 is fed directly onto a conveyor 44 to move in the direction of arrow E. Here the fabric relaxes further prior to entering a plaiting unit 46, situated at the front of the machine, which delivers the fabric in folds at floor level.

A machine control console (not shown) is situated adjacent the skip 2 at a side of the machine, so that a single operator can operate the machine and check that the fabric is being withdrawn correctly from the skip 2 and is being layered correctly in its finished condition by the plaiting unit 46.

The transverse stretchers 20 and 41 may be of the general type described in the British Pat. No. 1,041,051 or an equivalently functioning device.

The invention is particularly applicable to cotton interlock or rib bed knitted fabrics where the rollers 26 can reduce the water content to from 30 to 75% of the dry fabric weight. Naturally, fabrics of cotton in admixture with other fibers such as polyester can also be processed.

We claim:

1. Method of drying tubular knitted fabric on a continuous basis which method includes the steps of (A) overfeeding a rope of wet fabric after untangling to a first transverse stretcher;

(B) transversely stretching the untangled fabric to from 100% to 150% of a final dry fabric width to thereby bring the number of knitted course per unit fabric length to substantially that in the final dry fabric;

(C) expressing water by nip rollers from the transversely stretched fabric to remove water carried in the interstices of the fabric;

(D) overfeeding the expressed fabric to the exterior of a rotating drying drum at from 0% to 25%;

(E) revolving the fabric around the drum and reducing the water content to from 10% to 40% of the dry fabric weight while passing heated air from the drum exterior to its interior to thereby produce an unstretched, moist elastic fabric;

(F) drawing the fabric from the drum upwardly onto a second transverse stretcher to finally adjust the fabric width and obtain the final fabric width;

(G) blowing air at least partly recirculated from the drum interior onto the fabric on the second transverse stretcher to reduce the water content to less than 10% of the dry fabric weight, some of the air being diverted downwards inside the fabric to form a balloon intermediate the drum and the second transverse stretcher.

2. A method according to claim 1 in which a control member is arranged in a hot air supply duct adjustable to subdivide hot air supplied between the drum exterior and that supplied to the second transverse stretcher.

3. A method according to claim 2 in which a means is provided for removing lint and impurities from hot air supplied.

4. A method according to claim 1 in which the fabric is rib knitted fabric containing cotton.

5. A method according to claim 1 in which the drum is perforated and is associated with internal annular baffles to limit air flow through the perforations to those areas of the drum in contact with the fabric.

* * * * *